US011992173B2

(12) United States Patent
Rath

(10) Patent No.: US 11,992,173 B2
(45) Date of Patent: May 28, 2024

(54) FLOOR-CLEANING APPLIANCE

(71) Applicant: Philipp Rath, Drolshagen (DE)

(72) Inventor: Philipp Rath, Drolshagen (DE)

(73) Assignee: WESSEL-WERK GMBH, Reichshof-Wilbergerhuette (DE)

( * ) Notice: Subject to any disclaimer, the term of this patent is extended or adjusted under 35 U.S.C. 154(b) by 238 days.

(21) Appl. No.: 17/556,189

(22) Filed: Dec. 20, 2021

(65) Prior Publication Data

US 2022/0192447 A1 Jun. 23, 2022

(30) Foreign Application Priority Data

Dec. 21, 2020 (DE) ..... 102020134499.6

(51) Int. Cl.
*A47L 9/04* (2006.01)

(52) U.S. Cl.
CPC ..... *A47L 9/0477* (2013.01); *A47L 9/0494* (2013.01); *A47L 2201/00* (2013.01)

(58) Field of Classification Search
CPC .. A47L 9/0477; A47L 9/0494; A47L 2201/00; A47L 11/201; A47L 11/4047
See application file for complete search history.

(56) References Cited

U.S. PATENT DOCUMENTS 4,642,831 A * 2/1987 Roth ..... A47L 11/4036 15/4
2006/0048331 A1* 3/2006 Rau ..... A47L 11/4047 15/340.2

* cited by examiner

*Primary Examiner* — David Redding
(74) *Attorney, Agent, or Firm* — Andrew Wilford

(57) ABSTRACT

A floor-cleaning appliance has a housing movable in a working direction, forming a chamber, and having a downwardly directed intake opening extending in the working direction and in a transverse direction crosswise thereto. A front deflector and a rear deflector are provided in the opening with the latter spaced rearward in the working direction from the former. A flexible cleaning element is spanned over the deflectors and engageable with a floor surface below the housing.

19 Claims, 4 Drawing Sheets

FLOOR-CLEANING APPLIANCE

FIELD OF THE INVENTION

The present invention relates to a floor-cleaning appliance.

BACKGROUND OF THE INVENTION

A typical floor-cleaning appliance has a housing that extends in a working direction, in a transverse direction and in a vertical direction. The housing thus defines a cleaning chamber that opens though a cleaning opening on the underside (in the vertical direction).

Such a floor-cleaning appliance is placed on a floor surface to clean it and is used to loosen and remove dirt particles adhering to it and/or embedded in it. Various cleaning elements are known from the state of the art with which this purpose can be achieved or supported.

Many of these floor-cleaning elements have brush arrangements that are movable relative to the floor surface to be cleaned. In particular, brushes that rotate about a vertical axis are used in particular for feeding of dirt particles to a central collection point. Furthermore, arrangements with cleaning rollers that are mounted rotatably about horizontally extending axes. This way there is movement between the outer surface of the cleaning rollers and the surface to be cleaned so dirt particles can be loosened and particles can be loosened from it and, if necessary, transported away. In addition to their function of loosening dirt particles, the cleaning rollers can in particular also serve to move the dissolved dirt particles to a collection point, and to sweep or scoop them into the interior of the housing.

Depending on the condition and sensitivity of the floor to be cleaned, such cleaning rollers can be provided with special can be provided with special surfaces. In particular, bristles, foam and/or textile surfaces and/or covers are used.

The cleaning result with known floor-cleaning appliances can still be improved. For example, not all dirt particles can be safely loosened and removed from the floor. It is also problematic that particularly intimate contact between the cleaning element and the floor surface to be cleaned as occur with frequent cleanings and when dealing with especially dirty surfaces, the floor can be damaged.

OBJECTS OF THE INVENTION

It is therefore an object of the present invention to provide an improved floor-cleaning appliance.

Another object is the provision of such an improved floor-cleaning appliance that overcomes the above-given disadvantages, in particular that overcomes the above-given disadvantages.

SUMMARY OF THE INVENTION

A floor-cleaning appliance has according to the invention a housing movable in a working direction, forming a chamber, and having a downwardly directed intake opening extending in the working direction and in a transverse direction crosswise thereto. A front deflector and a rear deflector are provided in the opening with the latter spaced rearward in the working direction from the former. A flexible cleaning element is spanned over the deflectors and engageable with a floor surface below the housing.

This flexible cleaning element can in cooperation with the front deflector and the rear deflector provide a particularly large surface with which it can come into contact with the floor surface to be cleaned. This large contact surface makes it possible to achieve a particularly good cleaning effect even with low contact pressure. Compared to a cleaning roller with an especially large diameter, this design also has the advantage that a particularly low overall height (in the vertical direction) can be achieved.

Preferably, the front deflector is rotatable about a front transversely extending rotation axis. This way the first cleaning roller forms a first outer surface against which the flexible cleaning element rests. The front cleaning roller also is the front deflector. It applies a force on the cleaning element from above to press the cleaning element downward against a floor surface to be cleaned. The radius of the front cleaning roller can be adapted in particular to the space available in the floor-cleaning appliance. Particularly preferably a radius is chosen to be as large as possible within the existing space, in order on the one hand to provide a larger contact surface and on the other hand to bend the flexible cleaning element only to a small extent, i.e. in particular so as not overly bend it or break it.

According to a further preferred embodiment, the rear cleaning roller is mounted for rotation about a rear transversely extending rotation axis. In particular, the same considerations apply as in the case of the front cleaning roller.

It is particularly preferred that the front cleaning roller and/or the rear cleaning roller have a diameter between 1.5 cm and 6 cm. A corresponding radius of curvature is on the one hand large enough to avoid damaging the flexible cleaning element. On the other hand, in this value range a handy and space-saving construction can be guaranteed. In particular, cleaning rollers with such a size are suitable for the installation in household floor-cleaning equipment.

The front cleaning roller and/or the rear cleaning roller cleaning roller preferably has a width measured in the transverse direction that is at least 75%, preferably at least at least 90%, in particular at least 95% of the housing width. In this case, substantially the entire width of the housing can be used for cleaning with the flexible cleaning element. In particular, the front cleaning roller and/or the rear cleaning roller have a width of at least 20 cm, preferably at least 30 cm.

Depending on application profile and/or space requirements, the front deflector and/or the rear deflector can also be made so as not to rotate, thus as deflecting rods or guide surfaces running transversely. A corresponding deflecting surface can also be formed with a rounded, in particular circular, longitudinal section, i.e. perpendicular to the transverse direction.

It is preferred that the front cleaning roller and/or the rear cleaning roller be rotatably driven. This allows the flexible cleaning element to be moved relative to the floor surface to be cleaned. In particular, an electric motor is provided for this purpose in or on the housing and is connected to the front cleaning roller cleaning roller and/or the rear cleaning roller. To improve power transmission, the driven cleaning roller or rollers can be equipped with a drive groove or profile on their outer surface that fits with a complementary ridge or profile on the rear face of the cleaning element.

In particular, the electric motor(s) may be connected to the front and/or the rear cleaning roller by a toothed belt and/or gears. Alternatively or additionally, the electric motor may also be located in the front cleaning roller and/or the rear cleaning roller cleaning roller. Alternatively the cleaning rollers can also be driven by alternative forms of drive for example via air turbines.

According to a first preferred embodiment of the invention the cleaning element is wound onto the front cleaning roller and/or the rear cleaning roller. This way the cleaning element is guided in several full revolutions around at least one of the two cleaning rollers and extends from there to the other cleaning roller. In addition to providing relative movement of the cleaning element, the wound layers of the also serve as a "supply" of unused or clean material on the one hand or, on the other hand, used or contaminated material of the cleaning element.

An alternative preferred embodiment of the invention provides for the flexible cleaning element to circulate endlessly around the front deflector (in particular the front cleaning roller) and the rear deflector (in particular the rear cleaning roller). This makes it possible to move the flexible cleaning element constantly in the same direction. There is also no need for complex coordination of the movement of the two rollers in contrast to a variant, if the cleaning element is rewound from the front cleaning roller onto the rear cleaning roller.

Combinations are also conceivable, in which a flexible support belt is guided endlessly around the front deflector and the rear deflector. The flexible cleaning element can then be supported on the underside of the supporting belt. In particular, the flexible cleaning element can be guided independently of the front deflector and the rear deflector. unwound.

Particularly preferably, the flexible cleaning element is a cleaning tape. The cleaning element or belt is in particular flat. This means that its width running transversely and at most one tenth than its longitudinal extent.

Particularly preferably, the cleaning belt comprises a flexible substrate carrying at least one scrubbing element or formation. The substrate determines the shape of the cleaning belt and is guided on the front deflector and the rear deflector. The cleaning device is provided in particular for removing dirt particles from the floor surface to be cleaned and, if necessary, to transport them away. Particularly preferably the substrate and the cleaning device are in particular connected to one another over their entire surfaces.

The substrate can in particular be made of a preferably elastomeric plastic, in particular natural rubber or a synthetic rubber such as styrene-butadiene rubber (SBR). For dimensional stability, such a plastic substrate can be reinforced with fibers and/or textile reinforcements.

Preferably, the support has at least one textile layer and cam be formed entirely by the one textile layer. This textile layer may in particular have a woven or knitted structure. This has in particular the advantage of a high permeability to liquids and air. In addition, the textile layer can also simultaneously form at least part of the cleaning element. Preferably additional fibers can be woven or knitted into the textile layer.

In particular, a cleaning device is used on the surface of the substrate facing the surface of the support to be cleaned. The fiber structure can in particular be in the form of a fiber pile with free fibers and/or fiber tips protruding toward the floor surface to be cleaned. The fiber structure fulfils the function of a mop or wiping cloth, for wet and/or dry cleaning of the floor surface.

In order to improve the cleaning effect, the fibers are crimped or provided with microtexturing of the fibers (so-called microfibers). According to a particularly preferred embodiment of the invention, the fiber structure comprises a mixture of different fiber types, in terms of fineness, texturing and/or structuring.

In a preferred embodiment of the invention the floor cleaning floor-cleaning appliance is designed as a suction cleaning device. Thereby the cleaning chamber is connected or can be connected to a suction source.

The suction air duct of the suction cleaning device is provided with a blower for generating a suction air flow and further comprises a separator for separating dirt particles entrained in the suction air. In the event that wet cleaning is also being done a liquid separator can be installed preferably inside the dust separator.

In a suction-cleaning device, the cleaning action or effect is also increased by a suction cleaning component. This way the dirt particles loosened by the cleaning element are carried away with the suction air flow and collected in the separator. Furthermore, dirt particles taken up in the flexible cleaning element are preferably removed again by the suction air flow, so that the cleaning effect of the cleaning element is improved.

According to a variant of the invention, the suction air guide is directly connected to the cleaning chamber. The cleaning chamber thus fulfils the function of a suction conduit, in particular in a vacuum-cleaner floor nozzle. The bottom-wall further single opening (the lower cleaning opening) thus forms a so-called suction mouth.

Alternatively or additionally the suction line is directly connected to the flexible cleaning medium. This allows the suction effect (of dirt particles and, if applicable, moisture particles and possibly moisture) to be additionally intensified and concentrated.

According to a preferred embodiment the cleaning device is a vacuum cleaner nozzle for a vacuum cleaner. In the case of a (conventional) vacuum cleaner, the blower for generating the suction air flow as well as the separator are located in a separate vacuum cleaner housing (so-called canister cleaner). This is connected by the suction conduit with the vacuum cleaner floor nozzle. The suction line can in particular comprise a suction hose and/or a suction pipe.

According to a further preferred embodiment of the invention the suction-cleaning appliance is designed as a base part, also as a "attachment" of an upright vacuum cleaner. In an upright vacuum cleaner, the bottom part is directly connected to the vacuum cleaner housing or may be integral therewith.

According to a further preferred embodiment of the invention the vacuum cleaner is designed as a vacuum cleaning robot or as part of a vacuum cleaning robot. In particular vacuum cleaning robots benefit from the additional cleaning effect and the very small vertical space requirement of the flexible cleaning element. For energy efficiency, vacuum cleaning robots cannot regularly generate large amounts of suction over longer periods of time. Therefore robotic vacuum cleaners are usually equipped with additional brushes and bristle rollers. In the context of the present invention, this approach is additionally extended by the concept of a flexible cleaning element, which has a large cleaning effect with very low risk of damage to the floor surface. This way the cleaning effect relative to the energy input can be improved when the actual cleaning is achieved by the flexible cleaning element and the suction power is mainly, essentially or in particular or in particular completely concentrated on the flexible cleaning.

According to a particularly preferred embodiment, the front deflector and/or the rear deflector is designed to be adjustable in height. By adjusting the height of the deflector it is possible to determine with what contact force or contact pressure the flexible cleaning element will apply to a floor surface to be cleaned. Movability in the vertical direction can also be used to pick up coarse dirt particles and/or obstacles lying on the floor surface to be cleaned.

According to a preferred embodiment, the front deflector and/or the rear deflector can be fixed in discrete stepped height positions. In this way, different cleaning different cleaning conditions can be achieved in a targeted manner.

For example, at least the front deflector or the rear deflector is in a first height position set such that the flexible cleaning element is held in the region of the respective deflector above a support plane of the floor-cleaning appliance. of the floor-cleaning appliance. In this first height position the cleaning element, at least in this area, does not come into contact with the ground. A corresponding setting can be can be selected, for example, if no cleaning operation with the flexible cleaning element is desired for example in order to avoid damp mopping of sensitive wooden floors. It is also conceivable that the flexible cleaning element in a second area, in particular in the area of the respective other front or rear deflector or in the region of a further deflector, contacts the floor. Then the raised first height position causes the flexible cleaning element to form an inclined plane which, in particular, is suitable for sliding over large dirt particles.

Preferably, the front deflector and/or the rear deflector is set in a height position in such a way that the deflector is (preferably completely) above the support plane of the floor-cleaning appliance and the flexible cleaning element is vertically above the support plane. Particularly preferably, the flexible cleaning element is set vertically above the support plane by between 1 mm and 5 mm. The front deflector and the rear deflector are at this height position completely above the support plane. In this functional position the weight of the floor-cleaning appliance is supported by other supporting means, for example for example support rollers while the flexible cleaning element at least in the first area is essentially bearing "force-free" on the floor surface to be cleaned. Here contact with the floor is made with a low contact pressure. This way damage of floor material can be avoided as far as possible. At the same time friction is reduced between the flexible cleaning element and the floor surface.

Alternatively or additionally, in a third height position, the front deflector and/or the rear deflector is below the support plane of the floor-cleaning appliance. In this configuration the weight of the floor-cleaning appliance bears via the deflector and the flexible cleaning element directly on the floor surface. This makes it possible to generate a particularly large contact pressure in order to be able to carry out a particularly thorough cleaning if necessary.

The support level of the floor-cleaning appliance is defined by the underside or lower face of the housing or support elements arranged thereon. If the floor-cleaning appliance is designed as a subassembly of a larger component, these support elements can also be mounted on the housing. The elements form points that project furthest downward. These can, for example, be parts of the housing, in particular the edges of the opening on the underside, so-called suction mouth edges. Furthermore, the use of support rollers or wheels or skids is possible. The support level of the floor-cleaning appliance can also be varied in particular by adjusting the support elements. When the floor-cleaning appliance is set on a flat floor surface to be cleaned, the support plane is the same as the surface of this floor.

According to a particularly preferred design, an electromotive height adjustment is provided. For this purpose the front deflector and/or the rear deflector is coupled with an electromotive actuator. This is preferably connected to a controller that regulates operation of the actuator. In particular the desired height position is determined on the basis of user input and/or on the basis of measured parameters such as for example the speed of movement of the floor-cleaning appliance or the contact pressure. Automatic detection of the type of floor covering is also possible.

Alternatively or additionally, one or more height positions can be achieved by a mechanical selector element, in particular a rotary or toggle switch.

Preferably, the front deflector and/or the rear deflector in a first configuration (free-wheeling position) and/or at least in a first vertical range (free-wheeling range) is freely vertically movable. In the free-wheeling position the front deflector or the rear deflector rests with the flexible cleaning element guided thereon on a floor surface to be cleaned. Due to the free mobility in the direction, a quick and targeted adaptation to any unevenness of the floor is possible.

Alternatively or additionally the front deflector and/or the rear deflector in a second configuration (spring position) and/or in at least a second vertical range (spring range), is in particular spring-loaded. The pretensioning can thereby be downward in order to increase the bearing force in addition to its own weight. Likewise the pretensioning force can be directed upward, so that the contact pressure is reduced to less than the weight of the cleaning roller and element subassembly.

According to a particularly preferred embodiment, in a first free-running range, free vertical movement is permitted. Directly above and/or below the free-running range there is provided at least one pretensioning range where the pretensioning force is directed toward the free-wheeling range. This ensures a "soft" stop is ensured. The position of the "stop" and thus the size of the freewheel area can be established in particular by mechanical and/or electromechanical adjusters. It is also conceivable that the spring force within a spring position or a spring range can be regulated by adjusters.

It is particularly preferred that a selector switch moves the floor-cleaning appliance between the first configuration and the second configuration and/or the front deflector or the rear deflector in discrete vertically spaced steps.

It is particularly preferred that the cleaning element be coupled to a drive. The drive can on the one hand cause relative movement between the cleaning element and the floor surface to be cleaned in order to achieve a cleaning effect due to mechanical interaction. Alternatively or additionally a soiled area of the cleaning element can be taken off the floor surface to be cleaned and subsequently stored separately and/or reprocessed by cleaning for reuse.

For the drive of the cleaning element, the front deflector, in particular the front cleaning roller and/or an additional drive means is rotatably driven and mechanically coupled to the flexible cleaning element.

In a preferred embodiment, at least one central deflector is provided between the front deflector and the rear deflector, and the cleaning element passes over this at least one central deflector. The central deflector can have one or more functions. On the one hand, in particular in the case of a flexible cleaning element circulating endlessly, it is possible to tension the cleaning element through the central deflector. When working as a belt tensioner, the longitudinal tension of the flexible cleaning of the flexible cleaning element can be adjusted, especially in the working direction. Furthermore, it is possible to tension the deflector and the flexible cleaning element against a floor surface to be cleaned with out doing it in the region of the front deflector and/or the rear deflector. The means thus also acts as a pusher.

Particularly preferably, the central deflector is designed as a cleaning roller that is rotatable about a third rotation axis running transversely in the cleaning chamber about a third transverse rotation axis. This can be in particular a pressure roller and/or a tension roller.

According to a particularly preferred design, the central deflector. in particular the central cleaning roller. is guided in the cleaning chamber so as to be movable vertically. Its own weight and/or a mechanical preload (in particular spring loading) ensure that the central deflector can fulfil its pressing and/or tensioning function.

According to a preferred embodiment of the invention the floor-cleaning appliance comprises at least one dispenser for a cleaning liquid. In particular, the dispensing liquid comprises at least one dosing and/or pump unit with which doses of the cleaning liquid can be applied to the floor surface to be cleaned. For this purpose, a spray nozzle is preferably provided, that can spray the cleaning liquid onto the floor surface to be cleaned and/or onto the flexible cleaning element.

The dispensing of the cleaning element preferably takes place on the side of the side of the flexible cleaning element which comes into contact with the floor surface to be cleaned. In the case of a liquid-permeable cleaning element, the cleaning element can also be dispensed on the rear side facing away from the surface to be cleaned.

To provide the cleaning liquid, a reservoir is mounted on the floor-cleaning appliance and/or an adjacent assembly. Particularly preferably the reservoir is removable or replaceable.

Particularly preferably, the floor-cleaning appliance comprises a liquid scraper and/or a wringer that can squeeze excess cleaning liquid from the flexible cleaning element. The wringing device can press the flexible cleaning element, in particular during a movement relative to the housing so that the material of the flexible cleaning element holds less liquid. As a result, the liquid is at least partially removed from the flexible cleaning element, and in particular also dirt particles entrained in the cleaning liquid are separated.

According to a preferred embodiment, the stripping or wringing device has a preferred embodiment, the stripper or wringer has at least one wiping edge that adjacent the front deflector, the rear deflector means or a central deflector, so that a narrow gap remains between this deflector and the wiping edge. The wiping edge can in particular be designed as a rubber lip.

According to a further preferred alternative, the wiping or wringing device comprises at least one compression roller that presses the flexible cleaning medium against the front deflector, the rear deflector or a central deflector.

Furthermore, a pair of rollers can also be provided as a wringing device that forms a nip through which the flexible cleaning element is guided. According to a preferred embodiment the pair of rollers is rotatably driven. This can on the one hand be done a drive of the flexible cleaning element alone or alternatively the main drive of the flexible cleaning element can be relieved. Very preferably, the drive of the flexible cleaning element and the cleaning element and the pair of rollers are coupled to each other, preferably mechanically coupled to each other.

For discharge the cleaning liquid, which is removed by the wiping device or the wringing device, a collecting tray is preferably provided. This is particularly preferably connected to a suction air duct. Alternatively or additionally in the area of the scraper or wringer device wringing device excess dirt and cleaning liquid can be removed.

According to a particularly preferred embodiment of the front deflector, the rear deflector and the flexible floor-cleaning element guided thereon can be removed from the floor-cleaning appliance. This way an exchange or an external cleaning is possible.

The invention also relates to a method of operating the above-described floor cleaning apparatus that comprises at least one housing with a cleaning chamber arranged in the housing, forms a cleaning chamber, and open downward through a cleaning opening. In the cleaning chamber there is a front and a rear deflector spaced apart the working direction. A flexible deflector is spanned over both the front and the rear deflector. Preferably, the flexible cleaning element is coupled to a drive that is adapted to move the flexible cleaning element relative to the housing.

Preferably, the drive is set up for continuous operation. This way the flexible cleaning element is set to move relative to the housing. This is particularly useful in the case of an endlessly circulating cleaning element. Particularly preferably the direction of movement can be adjusted in particular by a selector switch or an electronic controller.

Alternatively or additionally the flexible cleaning element can be driven intermittently by the drive by the drive. In this case, time periods with a relative movement and an activated drive movement and activated drive alternate with such time periods with no relative movement.

Preferably, a movement phase in the intermittent operation is dimensioned in such a way that further travel of the flexible cleaning element takes place at least by an amount in length which corresponds to the distance between the front deflector and the rear deflector in the working direction. In this way it is possible. especially in particular for solutions in which the flexible cleaning element is unwound from a supply spool and rewound onto a storage spool, there is a complete exchange the material of the flexible cleaning element facing the floor surface to be cleaned.

Triggering of an active phase during intermittent operation can in particular be triggered manually. i.e. by the machine operator, time-controlled in fixed cycles and/or sensor-controlled. Relevant sensors are in particular pollution sensors and humidity sensors. For example, a further transport of the cleaning element in the standstill (detected by a motion sensor). It is also conceivable to automatically clean the cleaning element when a certain contamination and/or moisture threshold is exceeded.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
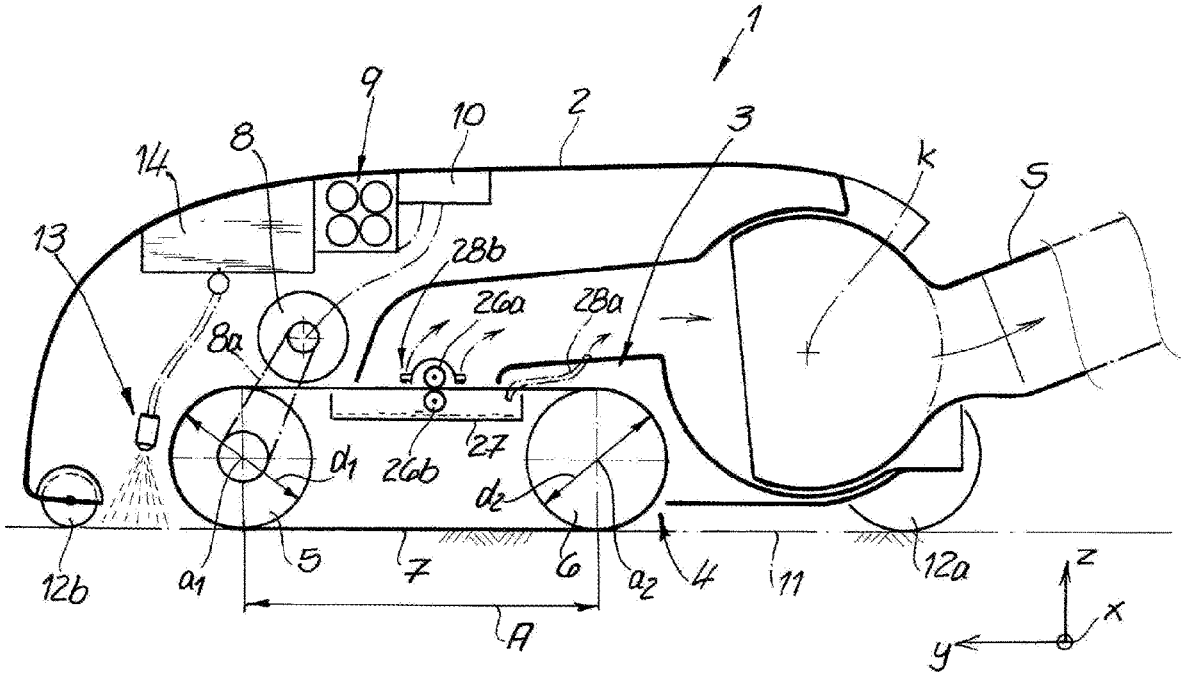
FIG. 1 is a longitudinal section through first embodiment of a floor-cleaning appliance according to the invention.

The floor-cleaning appliance 1 according to the invention has a housing 2 movable in a normally horizontal working direction y and is designed as a suction head for a vacuum cleaner. This housing 2 extends in the working direction y, in a transverse direction x, and in a vertical direction z. A suction pipe S is connected to a rear end of the housing 2. The suction connection pipe can pivot on the housing 2 about an axis k extending parallel to the transverse direction x and can be connected to the standard vacuum suction hose. Also, the vacuum appliance 1 of the invention can also be a nozzle assembly for an upright vacuum cleaner.

The housing 2 forms a chamber 3 having a downwardly open generally rectangular cleaning opening 4 extending in the transverse and working directions x and y. The housing 2 holds in the hole 4 a front deflector 5 and a rear deflector 6 spaced in the direction y rearward from the front deflector 5. A cleaning element 7 is guided around the front and rear deflectors 5 and 6. Here the front deflector 5 is a cleaning roller mounted in the housing 2 for rotation about a front axis $a_1$ running in the transverse direction x. The rear deflector 6 is designed as a roller that is rotatable about a rear axis $a_2$ that in turn also extends parallel to and rearward of the front axis $a_1$ in the transverse direction x.

An electric motor 8 is provided to drive the flexible cleaning element 7 and is coupled by a toothed belt to the front cleaning roller 5. In the illustrated embodiment, the electric motor 8 is driven by a power supply 9 held in the housing 2 in the form of a rechargeable battery and operated by a controller 10. Alternatively or additionally, the energy supply can also be provided externally, for example by an additional energy storage device such as a battery pack carried on the suction pipe and/or on the housing 2.

The housing 2 is supported on a floor surface 11 to be cleaned by rear rollers 12*a* and front rollers 12*b*. The axes of rotation $a_1$ and $a_2$ of the front cleaning roller 5 and of the rear cleaning roller 6 are relatively oriented such that the flexible cleaning element 7 engages the floor surface 11 to be cleaned. Due to its support on the front deflector 5 and the rear deflector 6 a particularly large contact surface is created whose size depends on the width of the flexible cleaning element 7 in the transverse direction x as well as a spacing A between the front rotation axis $a_1$ and the rear rotation axis $a_2$ in the working direction y. The height of the required ground clearance, on the other hand, is essentially determined by a diameter $d_1$ of the front deflector roller 5 and a diameter $d_2$ of the rear deflector roller 6.

In order to improve the cleaning effect, the cleaning device 1 further comprises a dispenser 13 for a cleaning liquid. This cleaning liquid is stored in a removable reservoir 14 in the housing 2. The dispenser is a spray nozzle and a feed pump for metered delivery of the cleaning liquid. In the illustrated embodiment, the nozzle of the dispenser 13 is oriented in such a way that an emerging mist of the cleaning liquid hits the floor surface 11 to be cleaned forward in the direction y from the front roller 5. The cleaning liquid serves to loosen dirt particles and the like from the surface of the floor 11 to be cleaned for easy removal. The dispenser 13 is also controlled by the controller 10.

Figure 2:
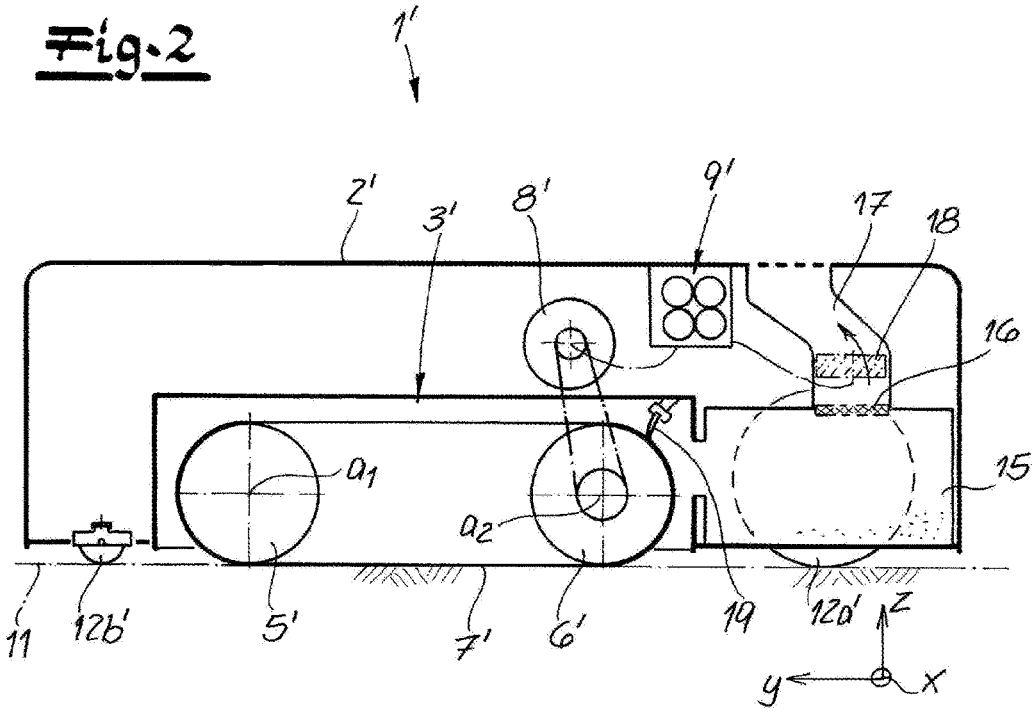
FIG. 2 is a longitudinal section through a second embodiment of a floor-cleaning appliance according to the invention.

FIG. 2 shows an alternative embodiment of a floor-cleaning appliance floor-cleaning appliance 1' according to the invention in the form of a vacuum cleaner robot shown in longitudinal section. This comprises a housing 2' provided with driven rear wheels 12*a*' that are rearward in the working direction y and a swivelling front support wheel 12*b*'. The housing 2' has a cleaning chamber 3' open on the underside and holds a flexible cleaning medium 7' that fits around a front deflector 5' and a rear deflector 6'. The housing 2' of the robot vacuum cleaner has a suction line with a dirt collection container 15, a filter element 16 as well as a suction air conduit 17 with a blower 18 therein. Both the blower 18 and a drive motor 8' coupled to the rear deflector 6' are supplied by a power supply 9'. The cleaning chamber 3' also holds a scraper 19 that wipes moisture off the flexible cleaning element 7', removing cleaning liquid in particular so it can be caught in the collecting chamber 15.

Figure 3A:
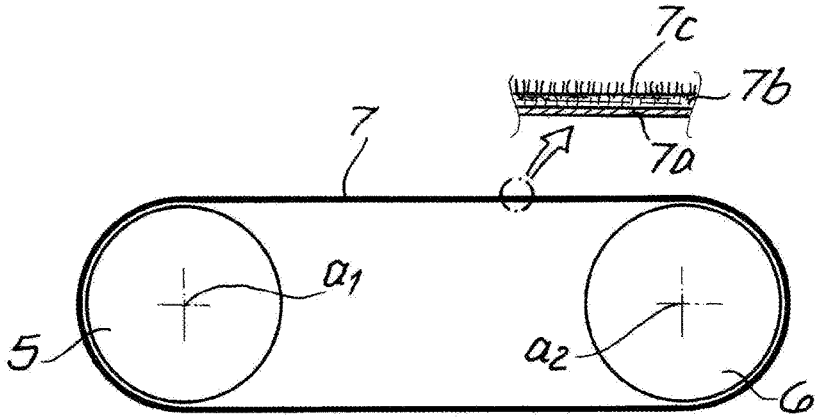
FIGS. 3A to 3D are simplified schematic views of various embodiments for guiding of the flexible cleaning element.

FIGS. 3A to 3D show different variants for guiding the flexible cleaning element within the scope of the present invention: FIG. 3A corresponds to the embodiments of FIGS. 1 and 2. The flexible cleaning element 7 is an endless cleaning belt, a closed loop, that wraps around both the front cleaning roller 5 and the rear cleaning roller 6. As shown in the enlarged detail of FIG. 3A the belt 7 has a substrate band 7*a* made of a synthetic rubber material and an outer textile cleaning layer 7*b* attached thereto to provide the desired cleaning or scrubbing effect. A fiber pile 7*c* projects from the cleaning layer 7*b* on its outer face directed away from the deflectors 5 and 6. The two deflector rollers 5 and 6 can both be driven synchronously. Also as shown in shown in FIGS. 1 and 2, only one of the two rollers can be driven, the front roller 5 in the FIG. 1 nozzle and the roller 6 for the FIG. 2 system can be guided by a front wheel 12*b'*.

Figure 3B:
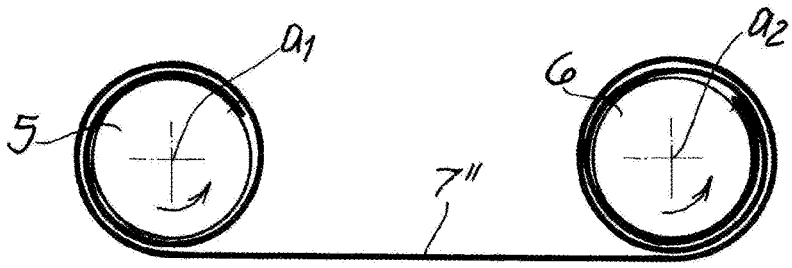

FIG. 3B shows an alternative design of the flexible cleaning element 7" in simplified form. A detailed view of the individual layers has been omitted. Here, one end section of the flexible cleaning element 7" shaped as a band or tape is wound in many layers around both the front deflector 5 and the rear deflector 6. By providing separate drives or an otherwise reversible drive system, it is possible to move the cleaning element 7" relative to the housing 2 or 2' for enhanced cleaning effect. Alternately the front and rear deflector rollers 5 and 6 can be used by paying out the cleaning element from one of the rollers and taking it up with the other of the rollers so when the exposed piece of the cleaning element needs to be changed, a fresh section can be moved into the hole 4. Moving the element 7 relative to the housing 2 by the rollers 5 and 6 allows one to mechanically clean a floor if that is necessary. Also, it is possible to move a dirty part of the cleaning element 7" out of contact with the surface 11 to be cleaned.

Figure 3C:
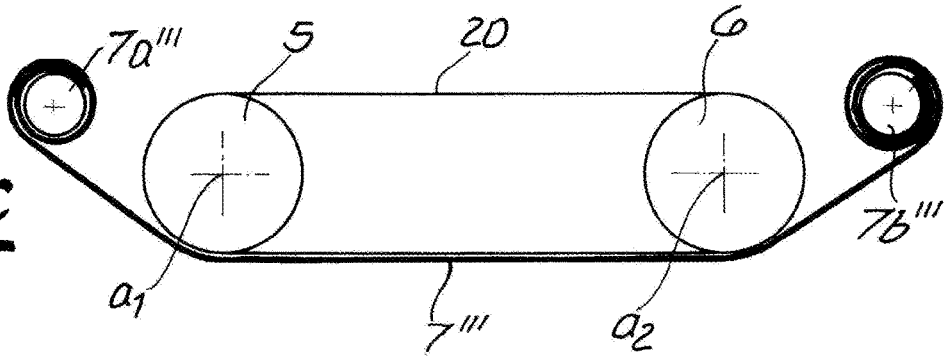

In a further preferred embodiment shown in FIG. 3C, an endless belt 20 is spanned between the front deflector 5 and the rear deflector 6. The lower reach of this belt 20 supports an alternative flexible cleaning element 7''' formed as a tape or band that has opposite end regions wound in multiple turns around separate supply and storage rollers 7*a*''' and 7*b*'''. This system eliminates the need for a physically strong flexible cleaning element since it is fully supported on the belt 20.

Figure 3D:
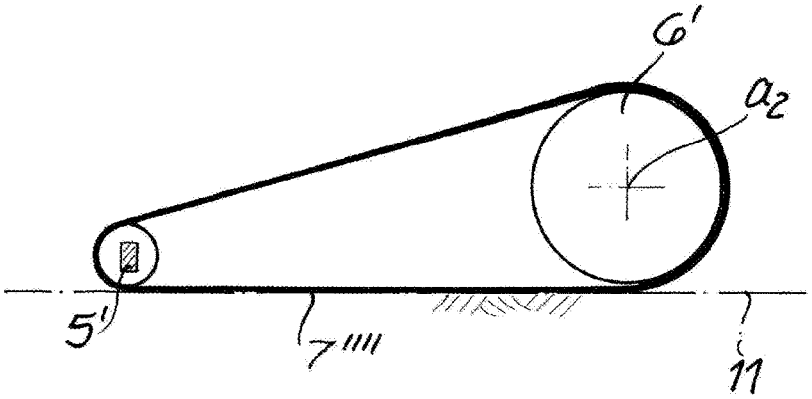

For the sake of completeness, it is pointed out that the rollers 5 or 6 are not limited to the cleaning rollers described above. FIG. 3D shows a rotatably driven cleaning roller 6' paired with a front deflector roller 5' that is both nonrotatable and of significantly smaller diameter than the drive roller 6'. The belt 7'''' is spanned over both the nonrotating roller 5' and the rotating roller 6'.

In particular, the invention also comprises variants in which the flexible cleaning element 7, 7', 7", 7'''' {in particular together with the deflectors 5, 6, 5', 6') is designed to be removable from the housing 2 or 2'. This allows in particular quick changing to unused or undamaged cleaning element 7, 7', 7'', 7'. Such an exchange is particularly preferred in a cartridge system.

Figure 4A:
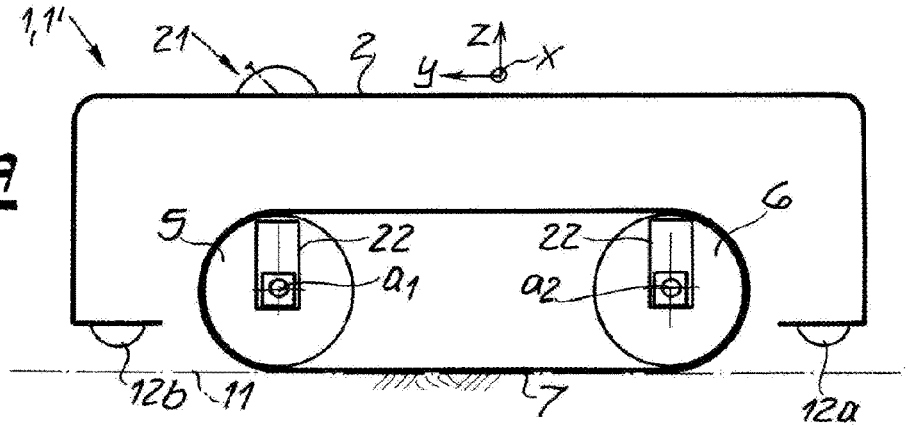
FIG. 4A to 4D show various embodiments for height adjustment of the deflectors.
Figure 4B:
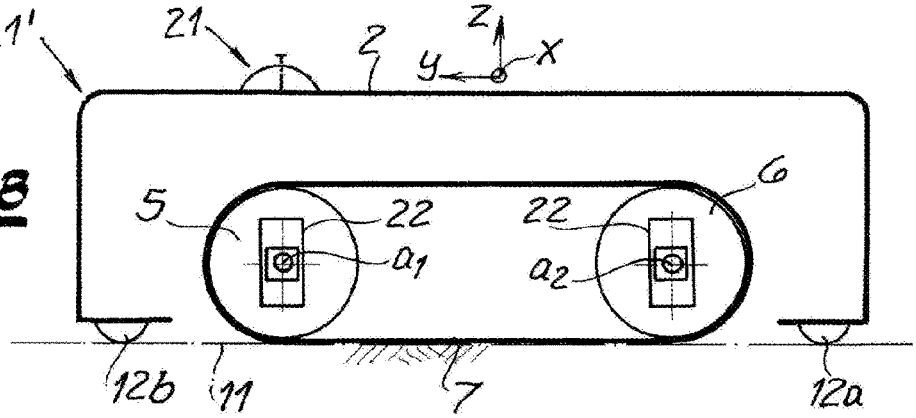
Figure 4C:
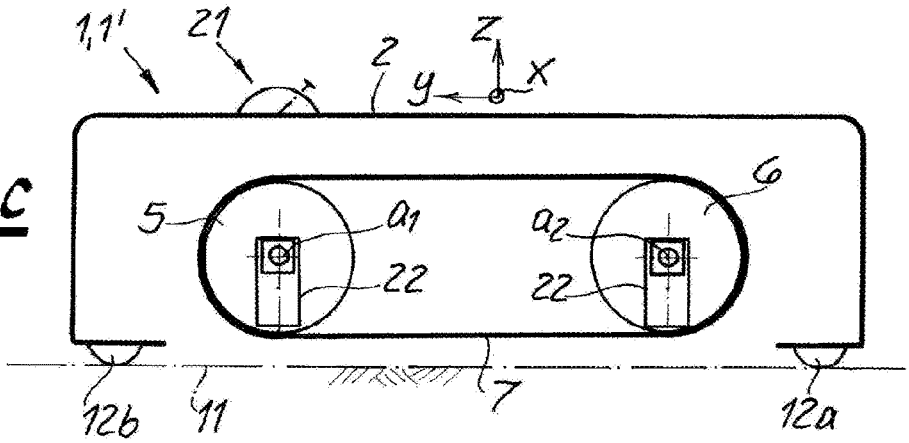

According to a particularly preferred embodiment of the invention, it is possible to adjust the height of at least one of the two deflector 5 and 6 as shown purely schematically in FIGS. 4A to 4C. This is effected in the instant floor-cleaning appliance 1 or 1'. The figures show another embodiment where the flexible cleaning element 7 is endless and spanned between a front cleaning roller cleaning roller 5 and a rear cleaning roller 6 that have respective front and rear rotation axes $a_1$ and $a_2$ and that extend in the transverse direction x. A mechanical selector switch 21 is provided on the housing 2 and can be set in different discrete setting positions.

FIG. 4A shows a first position in which both the front rotation axis $a_1$ and the rear rotation axis $a_2$ are maximally lowered. The two deflector 5 and 6 project down from the underside of the housing 2, so that the floor contact of the floor-cleaning appliance 1 or 1' is affected and the appliance almost exclusively supported on the flexible cleaning element 7 that bears directly on the floor surface 11 to be cleaned. A rear support element 12*b* as well as a front support element 12*a* 12*a* have no contact with the ground in this position and do not contribute to its support.

FIG. 4B shows a second position in which the underside of the flexible cleaning element 7 is in contact with the support plane formed by the front support element 12*b* and the rear support 12*a*. In this position, the bottom face of the bottom stretch of the flexible cleaning element 7 is aligned with the support plane formed by the front and rear support elements 12*a* and 12*b*. In this position, the cleaning element 7 is in contact with the floor but not bearing all the weight or exclusively supporting the weight of the floor-cleaning appliance 1 or 1'. Depending on the design or setting, the flexible cleaning element 7 can also rest "force-free" on the floor surface 11 to be cleaned.

In the third position shown in FIG. 4C the two deflectors 5 and 6 are raised in such a way that the flexible cleaning element 7 does not come into contact with a support surface. This position can be selected by the user if no cleaning contribution of the flexible cleaning element 7 is possible or desired. This can be the case with carpeted floors, for example.

In the embodiments shown in FIGS. 4A to 4C both the front rotation axis $a_1$ and the rear rotation axis $a_2$ are centered in a vertically extending guide 22. In this embodiment, the vertical position of the two rollers 5 and 6 can be adjusted in steps between the three positions shown. The axes of rotation $a_1$, $a_2$ are each arrested at these height settings.

Figure 4D:
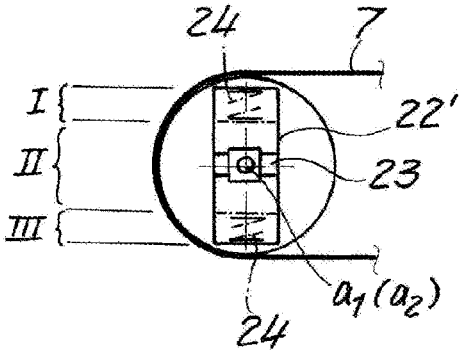

FIG. 4D shows an alternative design of the height adjustment. This is shown purely as an example for a rotation axis. A guide 22' holds a vertically movable slide block 23 that is mechanically coupled to a respective rotation axis $a_1$ or $a_2$. The slide block 23 can be in a first range II (free running range). In this the deflector coupled to the rotation axis or the flexible cleaning element guided thereon is moved downward under its under its own weight and possibly rests on a surface to be cleaned. Furthermore, there are an upper end spring area I and a lower end spring area III each provided with a respective spring element 24 that urges the respective slide block 23 toward the central free-wheeling region II.

Figure 5A:
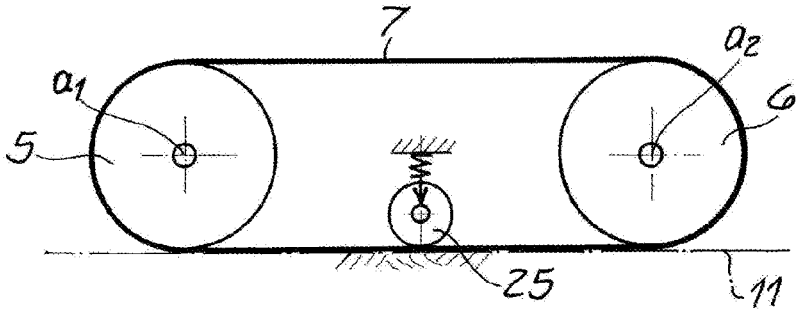
FIGS. 5A and 5B show different options of a central deflector.
Figure 5B:
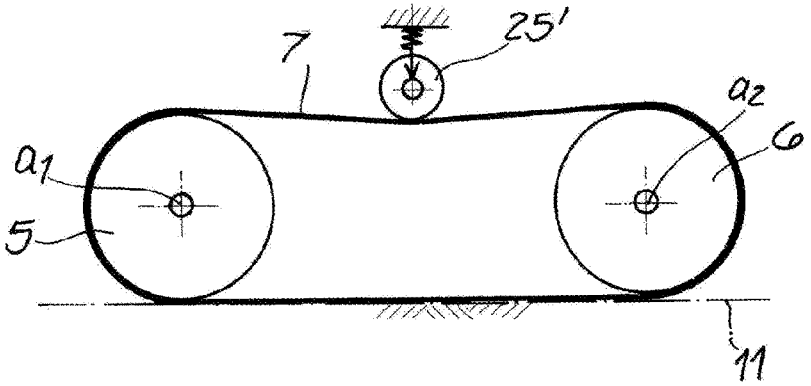

As a further option of the invention, it may be provided that a central deflector 25 is provided between the front deflector 5 and the rear deflector 6 as shown in FIGS. 5A and 5B. This deflector 25 is a pusher between the front deflector 5 and the rear deflector 6 that pushes the cleaning element 7 into contact with a floor surface 11 to be cleaned. According to FIG. 5B, the central deflector 25' can also be used as a belt tensioner that can maintain the required longitudinal tension in the element 7.

Figure 6A:
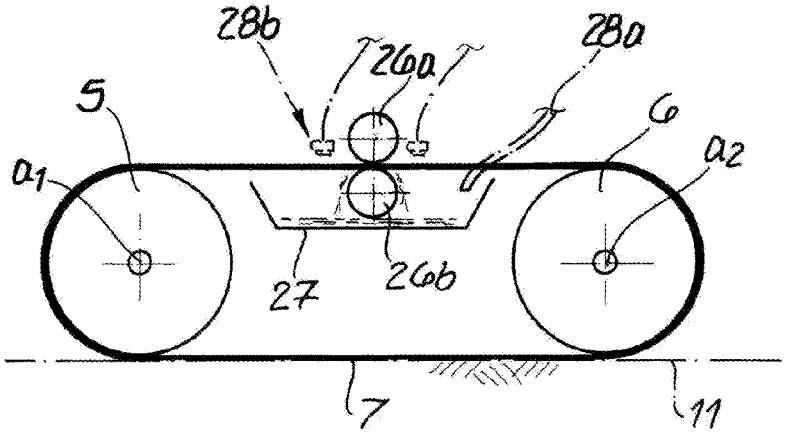
FIGS. 6A and 6B show various possibilities for a scraper.
Figure 6B:
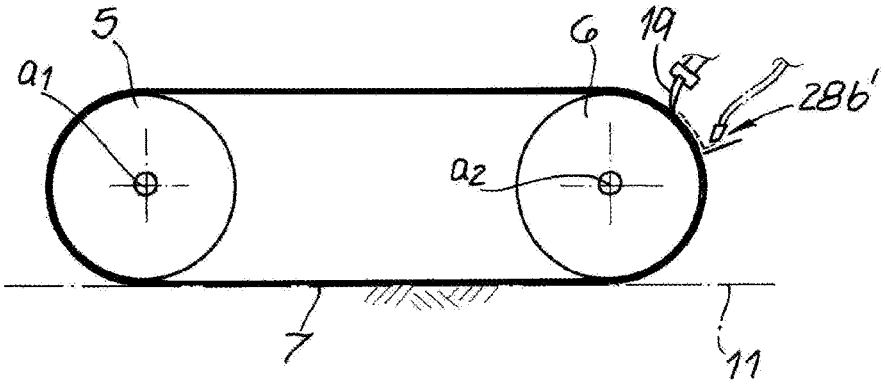

For the removal of excess liquid particles that are carried along in the flexible cleaning element 7, dewatering mechanisms may also be provided as shown by way of example in FIGS. 6A and 6B.

In FIG. 6A as in FIG. 1 a pair of rollers 26*a* and 26*b* forms a nip through which the flexible cleaning element 7 is passed. The flexible cleaning element 7 is compressed in this roller nip so that excess liquid is squeezed out of it and drips off into a collecting tray 27. This collecting tray 27 can be connected to disposal container via a suction line 28*a*. The collected liquid is sucked in and carried away. Alternatively or additionally, one can provide suction nozzles 28*b* at the pair of rollers 26*a* and 26*b* that are directly coupled with a suction line.

Alternatively or additionally a wiper lip 19 or a wiper element can be provided that presses against the cleaning element 7 to produce the required thickness compression. Such a scraper 19 can be closely juxtaposed by stripper nozzles 28*b'* that catch the escaping liquid. Such a targeted suction is necessary in particular if, as is particularly necessary in the case of a robot vacuum cleaner, only a relatively low suction power is available.

I claim:

1. A floor-cleaning appliance comprising:

a housing movable in a working direction, forming a chamber, and having a downwardly directed intake opening extending in the working direction and in a transverse direction crosswise thereto;

a front deflector in the opening;

a rear deflector in the opening spaced rearward in the working direction from the front deflector;

means for shifting of the deflectors vertically relative to the housing; and a flexible cleaning element spanned over the front and rear deflectors and engageable with a floor surface below the housing.

2. The floor-cleaning appliance according to claim 1, wherein the front deflector is rotatable about a front axis extending in the transverse direction.

3. The floor-cleaning appliance according to claim 2, wherein the rear deflector is rotatable about a rear axis extending in the transverse direction and spaced rearward in the working direction from the front axis.

4. The floor-cleaning appliance according to claim 3, further comprising:

drive means for rotating one of the deflectors about the respective axis.

5. The floor-cleaning appliance according to claim 3, wherein the cleaning element is wrapped around at least one of the deflectors.

6. The floor-cleaning appliance according to claim 3, wherein the floor-cleaning element is endless and extends around the front deflector and the rear deflector.

7. The floor-cleaning appliance according to claim 3, wherein the element is an endless scrubbing belt.

8. The floor-cleaning appliance according to claim 1, further comprising:

vacuum means connected to the housing for drawing air upward through the opening.

9. The floor-cleaning appliance according to claim 1, further comprising:

a conduit connected to the vacuum means.

10. The floor-cleaning appliance according to claim 1, wherein the appliance is part of an upright vacuum.

11. The floor-cleaning appliance according to claim 1, wherein the appliance is part of a vacuum-cleaner robot.

12. The floor-cleaning appliance according to claim 1, wherein the means for shifting defines a plurality of stepped and defined positions of the one deflector relative to the housing.

13. The floor-cleaning appliance according to claim 12, wherein the one deflector is freely vertically movable in one of the positions.

14. The floor-cleaning appliance according to claim 13, wherein the one deflector is biased in another of the positions into the one position by a spring.

15. The floor-cleaning appliance according to claim 14, further comprising:

a selector for moving the one deflector into the one position or the other position.

16. The floor-cleaning appliance according to claim 1, further comprising:

a drive coupled to the flexible cleaning element.

17. The floor-cleaning appliance according to claim 1, further comprising:

a central deflector between the front and rear deflectors over which the cleaning element moves.

18. The floor-cleaning appliance according to claim 17, wherein the central deflector is adjustable vertically in the housing.

19. The floor-cleaning appliance according to claim 1, further comprising:

means for applying a cleaning liquid.

* * * * *